United States Patent [19]

Gohda et al.

[11] 3,933,546

[45] Jan. 20, 1976

[54] METHOD FOR DRAINING WATER OR MOISTURE FROM SUBSTRATUM FOR WATERPROOFING LAYER

[75] Inventors: Hidekiyo Gohda, Osaka; Takashi Kiku, Kobe, both of Japan

[73] Assignee: Sumitomo Chemical Company, Limited, Japan

[22] Filed: July 19, 1974

[21] Appl. No.: 489,891

[30] Foreign Application Priority Data

July 25, 1973 Japan ..... 48-84352

[52] U.S. Cl. ..... 156/71; 34/14; 52/310; 52/741; 118/118; 156/293; 210/263; 210/510; 264/126

[51] Int. Cl.[2] ..... E04F 17/00

[58] Field of Search .... 52/310, 741; 210/263, 29 D, 210/291, 510; 118/414, 415, 118, 126; 156/71, 293; 34/14; 264/126

[56] References Cited

UNITED STATES PATENTS

| | | | |
|---|---|---|---|
| 2,438,528 | 3/1948 | Wilhelm et al. | 52/310 |
| 2,788,053 | 4/1957 | Dolbey et al. | 52/310 |
| 3,024,948 | 3/1962 | Rabl | 222/280 |
| 3,671,284 | 6/1972 | Uhrig | 118/59 |
| 3,842,006 | 10/1974 | Burt | 210/510 |

*Primary Examiner*—Edward G. Whitby
*Attorney, Agent, or Firm*—Stewart and Kolasch, Ltd.

[57] ABSTRACT

A method for draining water or moisture from a substratum for a waterproofing layer in buildings comprising applying to the substratum such as concrete or mortar a sintered product of a thermoplastic resin, having a capillary structure comprising numeral, fine and interconnecting pores and voids of 20 to 70 percent, selected from the group consisting of a sintered plate and a sintered hollow product in a form of a belt or tube, wherein at least a part of the sintered product is protruded into the atmosphere and applying thereto a waterproofing layer, and thereby making the water or moisture contained in the substratum evaporate through the sintered product.

7 Claims, No Drawings

METHOD FOR DRAINING WATER OR MOISTURE FROM SUBSTRATUM FOR WATERPROOFING LAYER

The present invention relates to a method for draining water or moisture from a substrate (substration) for a waterproofing layer which is used in a roof, floor or the like in buildings made of concrete, mortar or the like.

For improving the waterproofness of buildings, generally waterproofing with a waterproofing sheet or the like is applied to the roof, wall, floor or the like thereof. If the waterproofing is applied when the concrete, mortar or the like is not sufficiently dried, it is sometimes observed that the waterproofing layer is peeled off or blistered due to the moisture contained in the concrete or mortar. If the waterproofing is applied after the concrete or mortar has dried sufficiently, there is no problem. However, it requires a very long time to dry the concrete or mortar sufficiently, and therefore this procedure has a defect from the viewpoint of efficiency and economics. Moreover, even if the waterproofing is applied after the concrete or mortar is fairly dried, a moisture condensation occurs on the surface thereof owing to the change of indoor or outdoor temperature, which causes the peeling off or blistering of the waterproofing layer.

Recently, for waterproofing of the roof in concrete buildings, there have been used asphalt roofing, urethane coatings, rubber roofing sheets, or the like. However, such roofing is shrunk or expanded owing to the change of the atmospheric temperature after the roofing is applied, and thereby the roofing is peeled off from the surface of the concrete, which causes the leak of water. Such defect depends on the mechanical properties, molding strain, adhesive force of the roofing material, and additional factors as follows. That is, the moisture contained in the concrete is evaporated by sun light but can not be taken out because it is inhibited by the waterproofing roofing, and the evaporated moisture is condensed when the atmospheric temperature lowers at night, which decreases the adhesive force of the roofing to the surface of concrete and thereby the peeling off or blistering of the roofing is promoted, and as the result, there are observed the uneven surface of the roofing at the upper part of the roofing and further the sagging of the roofing at the upstand. These disadvantageous phenomena are observed more frequently in case of rubber roofing which is inferior in adhesion between the roofing and the concrete.

Under the circumstances, it has been studied to find a method for removing such defects, and it has now been found that it is useful for such purpose to drain the water or moisture from the interface of the waterproofing layer and the concrete by using a sintered product of a thermoplastic resin.

An object of the present invention is to provide a method for draining water or moisture from a substrate (substration) for the waterproofing layer in buildings.

Another object of the invention is to provide a method for preventing the peeling off or blistering of the waterproofing layer from the concrete, mortar or the like in buildings.

A further object of the invention is to provide a sintered product of a thermoplastic resin useful for the draining of water or moisture from the substration for the waterproofing layer.

These and other objects of the invention will be apparent from the description hereinafter.

According to the present invention, the draining of water or moisture from the substration for the waterproofing layer can be effected by putting a sintered product of a thermoplastic resin, having a capillary structure comprising numeral, fine and interconnecting pores and voids of 20 to 70 percent, selected from the group consisting of a sintered plate and a sintered hollow product in a form of a belt or tube on the surface of the substration such as concrete or mortar at appropriate intervals so that at least a part of the sintered product is protruded into the atmosphere, and applying thereto a waterproofing layer. According to such method, the water or moisture contained in the interface of the waterproofing layer and the substration is discharged to the atmosphere through the sintered product without condensation, and as the result, the peeling off or blistering of the waterproofing layer is effectively prevented.

The thermoplastic resin used in the present invention includes any of the resins which are powdery and which can be sintered, and the preferred resin is polyvinyl chloride or a vinyl chloride copolymer which can be obtained in the form of a powder by the conventional polymerization and can be easily sintered.

The preferred examples of the vinyl chloride copolymer are a copolymer of vinyl chloride with vinylidene chloride, acrylic acid, an acrylic acid ester (e.g. methyl acrylate, ethyl acrylate, propyl acrylate or butyl acrylate), methacrylic acid, a methacrylic acid ester (e.g. methyl methacrylate, ethyl methacrylate, propyl methacrylate or butyl methacrylate), a vinyl ether (e.g. lauryl vinyl ether or cetyl vinyl ether) a vinyl ester (e.g. vinyl formate, vinyl acetate, vinyl acrylate or vinyl propionate), ethylene, propylene or the like. Furthermore, there may be used a graft copolymer which is prepared by graft-copolymerizing vinyl chloride with ethylene-vinyl acetate copolymer.

These thermoplastic resins may be used alone, but may be optionally used in the form of a dryblend with other suitable additives, such as a stabilizer or a plasticizer. The resins have preferably a particle size of 60 mesh or less for giving a homogeneous sintered product.

The desired sintered product of the thermoplastic resin, e.g. the sintered plate, may be prepared by spreading a thermoplastic resin powder on a heat resistant carrier such as a steel belt or a knitted cloth of glass fiber which is coated with a fluorocarbon resin (Teflon, trade name of DuPont) by a knife or roll to form a powder layer having a fixed thickness and then heating it at 200° – 300°C for 90 to 180 seconds to fuse the powder particles at the contact interface thereof, by which the voids between the powder particles are maintained and the capillary structure comprising numeral, fine and interconnecting pores is formed. When the particle size of the starting powder is smaller, the size of the formed pores is smaller.

The degree of the sintering may vary depending on the temperature and time of the heat treatment, and when the heat treatment is carried out at a higher temperature and for a longer time, the sintering proceeds to a greater extent, and as the result, the sectional area of the fused parts increases and the voids decrease. When the voids are less than 20 percent by volume fraction of the pores, the effect for draining water or moisture is inferior, and on the other hand, when the voids are more than 70 percent, the sintered product is brittle and can not be practically used.

Moreover, by using a knife or roll having channels for spreading the thermoplastic resin powder, there may be obtained a sintered product having raised portions at the surface. Furthermore, when a belt-type sintered plate having such raised portions at the surface is laminated with another one or with a plain plate so that the surface having the raised portions becomes the inner face by heat-fusing or by using an adhesive, there may be obtained a belt-type hollow product.

The sintered product of thermoplastic resin thus formed has a capillary structure, by which the draining of water or moisture can be performed. The water or moisture is transferred by capillarity, and when the sintered product is protruded to the atmosphere, the water or moisture is discharged through the sintered product to the atmosphere. Moreover, by using a sintered hollow product being in the form of a belt or tube, the water or moisture may be discharged through the hollows.

The capillary structure or the hollow structure of the sintered product of the thermoplastic resin in the present invention is not changed under ordinary weather conditions and can exhibit the excellent effect for draining of water or moisture for a long time.

The sintered product may be used alone or in the form of a laminate with another insulating material, such as polyurethane foam, polystyrene foam, polyethylene foam, or glass-wool.

According to the present invention, the sintered product may be applied to not only the waterproofing of a roof, but also the waterproofing of a wall or floor in a bath room, a kitchen, a rest room or the like and further in a basement, and the present method may be used for draining water or moisture from the substration for the waterproofing layer anywhere in a building.

The present invention is illustrated by the following Examples but is not limited thereto.

EXAMPLE 1

A. Polyvinyl chloride power suitable for sintering (Sumilit MPX, trade name of Sumitomo Chemical Company, Limited) is continuously supplied to an endless stainless steel belt and spread thereon in a thickness of 1.5 mm by a knife, and the resultant is passed through a tunnel furnace having 240 cm in length at a temperature of 300°C and at a speed of 100 cm/minute and thereby sintered. The resultant is cooled and then taken off from the belt to give a sintered plate having the form of a belt and having a thickness of 1.2 mm and voids of 40 percent.

B. Polyvinyl chloride powder suitable for sintering as used in the above (A) as spread on a steel belt in a thickness of 3.2 mm in the same manner as in the above (A) and then a roll having channels of 2.0 mm in depth at fixed intervals is passed thereon to form a powder layer having raised portions. The resultant is then heated and cooled in the same manner as described in the above (A) to give a sintered plate having the form of a belt and having a thickness of 0.8 mm and 1.5 mm at the flat and the raised portion, respectively, and further voids of 43 and 20 percent at the flat and the raised portion, respectively.

The sintered plate obtained in (A) is laminated with the sintered plate obtained in (B) so that the raised portion of the sintered plate in (B) becomes the inner face to give a sintered hollow product having the form of a belt.

The sintered hollow product thus obtained is cut in a size of 10 cm in width and 50 cm in length, and the resultant is vertically stood in a 1,000 cc beaker containing 750 cc of water, which is covered with a saran film so that any water does not evaporate other than through the sintered product. The beaker provided with the sintered product is allowed to stand at room temperature (9° – 18°C) and at a humidity of 50 – 76 percent, and then the water is evaporated through the sintered product. During a period of 44 hours, 105 cc of water is evaporated.

On the other hand, when a 1,000 cc beaker containing 750 cc of water wherein no sintered product is placed is allowed to stand without coverage for 44 hours in a like manner, only 65 cc of water is evaporated.

EXAMPLE 2

Two sintered plates as obtained in Example 1-(B) are laminated with each other so that both the faces having raised portions become the inner face and the raised portions are mutually positioned to give a sintered hollow product having the form of a belt.

The sintered hollow product thus obtained is cut in a size of 100 mm in width and 340 mm in length and then adhered to the outside wall of a steel box (thickness of steel: 0.5 mm, size of box: 230 mm × 230 mm × 340 mm) which is filled with ice. Two pans are put right under the sintered product and the part without the sintered product, respectively, and the steel box is allowed to stand at a temperature of 30°C and at a humidity of 80 percent for 5 hours.

On the outside wall of the steel box without the sintered product, a water condensation occurs, but not on the wall adhered with the sintered product and the condensed water is dropped through the sintered product onto the pan. The total amount of the water collected in the pan put under the sintered product is 89 g. On the other hand, 44 g of water is collected in the pan put under the part without the sintered product. These results mean that the sintered product of the present invention shows an excellent effect for preventing the occurrence of moisture condensation and for draining water.

EXAMPLE 3

A floor (length: 3 m, width: 2 m, area: 6 $m^2$) is fenced with a wooden frame and covered with polyethylene film, and thereon three of the sintered hollow products obtained in Example 1 (width: 10 cm, length: 244 cm, thickness: 3 mm) are placed at intervals of 1 meter and thereto water (18 liters) is added. Each of the sintered products is protruded into the atmosphere in an amount of 6 cm in both sides and the other part thereof is covered with polyethylene film. Dry sand (170 kg) is put thereon for minimizing the change of the temperature. The floor is allowed to stand for 72 hours. During the 72 hours, 9.5 liters of water is evaporated.

As a control, the above test is repeated except that the sintered product is not used and instead thereof an opening having the same area as the sectional area of the sintered products is provided to the coverage of the floor. As the result, 1.8 liters of water is evaporated.

This test result means that the sintered hollow product of the present invention shows an excellent effect for draining water.

EXAMPLE 4

Concrete is laid on the ground outdoors in an area of 6 $m^2$ (length: 3 m, width: 2 m), and thereto is applied a mortar for leveling. After 20 days, to the concrete levelled with a mortar is applied Neoprimer and Neobond (each, trade name of a primer and a bonding agent made by Mitsuboshi Belt K.K., respectively) in order, on which the sintered product obtained in Example 1 is put in the same manner as in Example 3, and further thereto is applied a roofing (Neoroofing EB, trade name of Mitsuboshi Belt K.K.) to effect a waterproofing. After 30 days from the application of the waterproofing, no change is observed on the surface of the waterproofing layer.

As a control, the above test is repeated except that no sintered product is used. As the result, the middle part of the roofing is blistered in a dome-like shape (diameter: 50 cm, height: 5 cm), and much water condensation is observed on the back side of the roofing at the blistered part.

From these results, it is made clear that the sintered product of the present invention shows an excellent effect for draining water or moisture.

What is claimed is:

1. A method for draining water or moisture from a substratum for a waterproofing layer in buildings, which comprises applying to the substratum a sintered product of a thermoplastic resin, having a capillary structure comprising numeral, fine and interconnecting pores and voids of 20 to 70 percent, selected from the group consisting of a sintered plate and a sintered hollow product in the form of a belt or tube, wherein at least a part of the sintered product is protruded into the atmosphere, and applying thereto a waterproofing layer, and thereby making the water or moisture contained in the substratum evaporate through the sintered product.

2. The method according to claim 1, wherein the sintered product is prepared by spreading a thermoplastic resin powder on a heat resistant carrier by a knife or roll to form a powder layer and then heating it to fuse the powder particles at the contact interface thereof.

3. The method according to claim 2, wherein the knife or roll has channels.

4. The method according to claim 2, wherein the sintered hollow product is prepared by spreading a thermoplastic resin powder on a heat resistant carrier by a knife or roll having channels to form a powder layer, heating it to fuse the powder particles at the contact interface thereof, and then laminating the resulting sintered plate having raised portions at the surface with another sintered plate or with a plain plate wherein the surface having the raised portions becomes the inner face.

5. The method according to claim 1, wherein the thermoplastic resin is a member selected from the group consisting of polyvinyl chloride, a vinyl chloride copolymer and a graft copolymer of vinyl chloride with ethylene-vinyl acetate copolymer.

6. The method according to claim 5, wherein the vinyl chloride copolymer is a copolymer of vinyl chloride with a monomer selected from the group consisting of vinylidene chloride, acrylic acid, an acrylic acid ester, methacrylic acid, a methacrylic acid ester, a vinyl ether, a vinyl ester, ethylene and propylene.

7. The method according to claim 1, wherein the substratum is concrete or mortar.

* * * * *